US007946282B2

(12) United States Patent
Jones

(10) Patent No.: US 7,946,282 B2
(45) **Date of Patent: *May 24, 2011**

(54) ARCHERY RELEASE

(75) Inventor: Brian K. Jones, Winchester, KY (US)

(73) Assignee: Scott Archery Manufacturing, Clay City, KY (US)

( * ) Notice: Subject to any disclaimer, the term of this patent is extended or adjusted under 35 U.S.C. 154(b) by 524 days.

This patent is subject to a terminal disclaimer.

(21) Appl. No.: 12/061,184

(22) Filed: Apr. 2, 2008

(65) Prior Publication Data

US 2009/0250047 A1 Oct. 8, 2009

(51) Int. Cl.
*F41B 5/18* (2006.01)

(52) U.S. Cl. ..... 124/35.2

(58) Field of Classification Search ..... 124/35.2
See application file for complete search history.

(56) References Cited

U.S. PATENT DOCUMENTS

| | | | | |
|---|---|---|---|---|
| 228,302 | A * | 6/1880 | Beard | 124/35.2 |
| 229,089 | A * | 6/1880 | Burnham | 124/35.2 |
| 4,036,204 | A | 7/1977 | Scott | |
| 4,160,437 | A | 7/1979 | Fletcher | |
| 4,567,875 | A | 2/1986 | Fletcher | |
| 4,574,767 | A | 3/1986 | Gazzara | |
| 4,620,523 | A | 11/1986 | Peck | |
| 4,674,469 | A | 6/1987 | Peck | |
| 4,881,516 | A | 11/1989 | Peck | |
| 5,205,268 | A | 4/1993 | Savage | |
| 5,448,983 | A | 9/1995 | Scott | |
| 5,595,167 | A | 1/1997 | Scott | |
| 5,596,977 | A | 1/1997 | Scott | |
| 5,765,536 | A | 6/1998 | Scott | |
| 5,803,068 | A * | 9/1998 | Summers | 124/35.2 |
| 5,850,825 | A | 12/1998 | Scott | |
| 6,032,661 | A | 3/2000 | Goff et al. | |
| 2010/0108047 | A1 * | 5/2010 | Jones | 124/35.2 |

* cited by examiner

*Primary Examiner* — John Ricci
(74) *Attorney, Agent, or Firm* — Warner Norcross & Judd LLP

(57) ABSTRACT

An archery release including a release body having a longitudinal axis, a fixed jaw having a bowstring facing surface being offset at a first predetermined angle from the longitudinal axis, and a movable jaw. The moveable jaw can define a bowstring notch, and can include a surface forward of the notch which opposes the fixed jaw. The moveable jaw surface can be offset at a second predetermined angle from the longitudinal axis, and can be substantially parallel to and oppose the bowstring facing surface when the moveable jaw is in a closed position. The first predetermined angle and/or the second predetermined angle can be about 0.1° to about 30°, about 0.1° to about 5°, or about 3° offset from the longitudinal axis. A method also is provided for drawing and releasing a bowstring with the assistance of the release.

21 Claims, 3 Drawing Sheets

ARCHERY RELEASE

BACKGROUND OF THE INVENTION

The present invention relates to an archery bowstring release.

Conventional archery releases are designed to temporarily hold a bowstring of an archery bow so that an archer can pull on the release and subsequently draw the bowstring to shoot an arrow from the bow. Archery releases typically assist an archer in quickly and cleanly releasing the bowstring. In general, archery releases consistently release the bowstring when the archer shoots the arrow, and thus increase the accuracy of the archer.

Most releases include a head which houses a trigger mechanism, pivotable jaws that hold the bowstring, a trigger mechanism that actuates the jaws, and a wrist strap or handle designed so that a user can hold the release. In use, an archer nocks an arrow on the bowstring and secures the jaws of the release around the bowstring, which as used herein, refers to a bowstring, a release loop joined with the bowstring and/or a release receiver joined with the bowstring. The user then draws the bowstring by pulling the release. After the user fully draws the bowstring, aims the bow and is prepared to shoot the arrow, the user actuates the trigger mechanism. This moves the jaws and subsequently disengages the bowstring so that the bowstring can utilize its stored energy and propel the arrow from the bow.

A common type of archery release is referred to as a "fixed jaw" or "single caliper" release. An example of a popular fixed jaw release is shown in U.S. Pat. No. 5,448,983 to Scott, which is incorporated herein by reference. Related examples include Scott Archery Manufacturing's "Wildcat," "Mongoose," and various "Goose" single caliper releases. These releases generally include a release head having a movable jaw that moves relative to a fixed jaw. The moveable jaw usually includes a bowstring notch that opposes a flat portion of the fixed jaw. In use, the bowstring is placed within the bowstring notch, and the movable jaw is closed so that the bowstring is captured between the notch and the flat surface of the fixed jaw. Typically, when the moveable jaw is closed, its flat, forward most portion (forward of the notch) is positioned adjacent the flat surface of the fixed jaw, with a small gap being defined between these features.

The applicants have discovered that this particular configuration of a fixed jaw release, however, presents two issues. First, as or after an archer draws the bowstring with a fixed jaw release, the bowstring has a tendency to "fight the gap" of the release, which is a phenomenon where the bowstring is forcefully crammed into the small gap noted above. Accordingly, at full draw, with the bowstring fighting the gap, pushing the moveable jaw against the trigger mechanism, an archer must exert additional force to actuate the trigger mechanism, which can decrease the sensitivity and performance of the trigger. In turn, this can produce "trigger jerk," and cause erratic arrow flight when the release disengages the bowstring. Another consequence of the bowstring fighting the gap of the release is that the string may prematurely wear where it engages the gap.

A second issue with such fixed jaw releases arises as the bowstring is released. Specifically, the flat, opposing surface of the fixed jaw is constructed so that it aligns in parallel with a longitudinal axis of the release head, along a straight 0° line. When the movable jaw opens, the bowstring slides along the fixed jaw surface of the release. Thus, if the archer moves the release (even slightly as this occurs) the fixed jaw can inadvertently engage the bowstring to cause erratic arrow flight.

Moreover, because the forward most portion of the movable jaw is likewise aligned and parallel with the longitudinal axis of the release body, that portion obstructs the forward path of the bowstring as the bowstring is released. This, as well, can inadvertently disturb the bowstring travel path and subsequently cause erratic arrow flight.

SUMMARY OF THE INVENTION

The present invention provides an archery release including: a release body having a longitudinal axis; a fixed jaw; and a movable jaw defining a bowstring notch and having a portion forward of the notch. One or both of the fixed jaw and movable jaw forward portion includes a surface that is offset at a predetermined angle from the longitudinal axis of the release body.

In one embodiment, at least a portion of the fixed jaw can be offset by a predetermined angle relative to the longitudinal axis. Optionally, the portion can be a forward portion of the fixed jaw. Further optionally, the predetermined angle can be about 0.1° to about 30°, about 0.1° to about 25°, about 0.1° to about 15°, about 1° to about 6°, and/or about 3° offset relative to the longitudinal axis.

In another embodiment, at least a portion of the movable jaw, for example, a portion forward of the bowstring notch, can be offset relative to the longitudinal axis by a predetermined angle. Optionally, that predetermined angle can be the about same as the predetermined angle of the fixed jaw, with the offset surfaces of the fixed jaw and movable jaw generally parallel to one another when the movable jaw is in a closed position.

In yet another embodiment, a forward portion of the fixed jaw can be substantially planar and offset relative to the longitudinal axis by a predetermined angle. Optionally, the forward most portion of the movable jaw, forward of the bowstring notch, can be substantially planar and offset relative to the longitudinal axis at about the same predetermined angle as the forward portion of the fixed jaw when the moveable jaw is in a closed position.

In a further embodiment, the fixed jaw can be joined with the release body at a release body end, and can extend away from the body and terminate at a terminating end. Between the release body end and the terminating end, the fixed jaw can include a bowstring facing surface, at least a portion of which is offset at a predetermined angle relative to the longitudinal axis of the release body. Optionally, the offset portion can be located adjacent the terminating end.

The present invention provides a simple and efficient archery release that cleanly and consistently releases an archery bowstring. The release can prevent or eliminate the phenomenon where the bowstring fights the gap, thereby reducing or preventing jerking of the release as the trigger is actuated. In turn, this can reduces erratic arrow flight and improve accuracy. Where the portion of the fixed jaw is offset a predetermined angle relative to the longitudinal axis of the release body, the string's contact with the fixed jaw as the release actuates is minimized or prevented, thereby reducing or eliminating the release's potential effect on arrow flight. Further, where the portion forward of the notch defined by the movable jaw is offset a predetermined angle relative to the longitudinal axis of the release body, that portion is less likely to interfere with the bowstring as the bowstring travels forward upon release.

These and other objects, advantages and features of the invention will be more readily understood and appreciated by reference to the detailed description of the invention and the drawings.

DETAILED DESCRIPTION OF THE PREFERRED EMBODIMENT

I. Overview and Definitions

Figure 1:
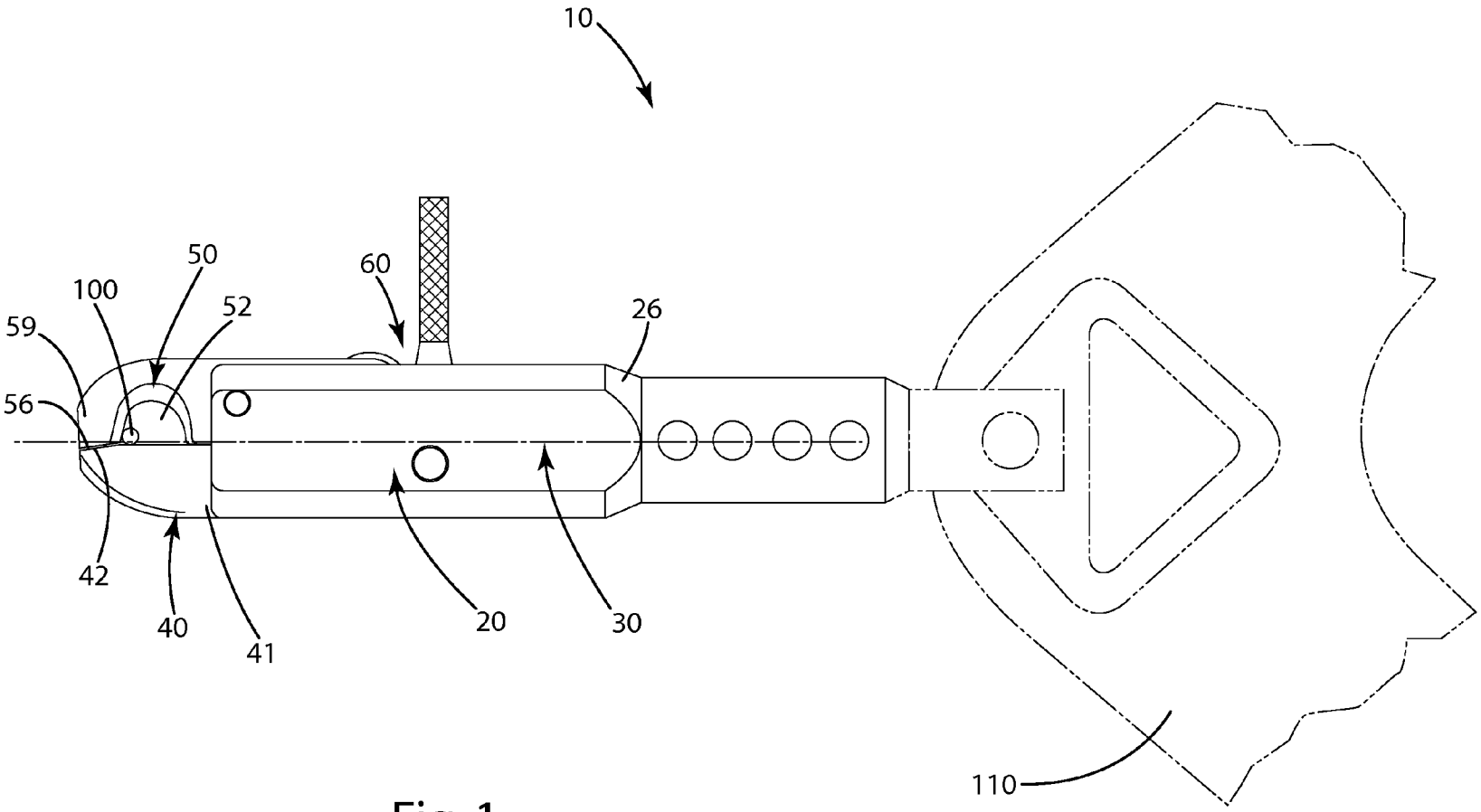
FIG. 1 is a top view of the archery release of the present invention in a closed position holding a bowstring.
Figure 2:
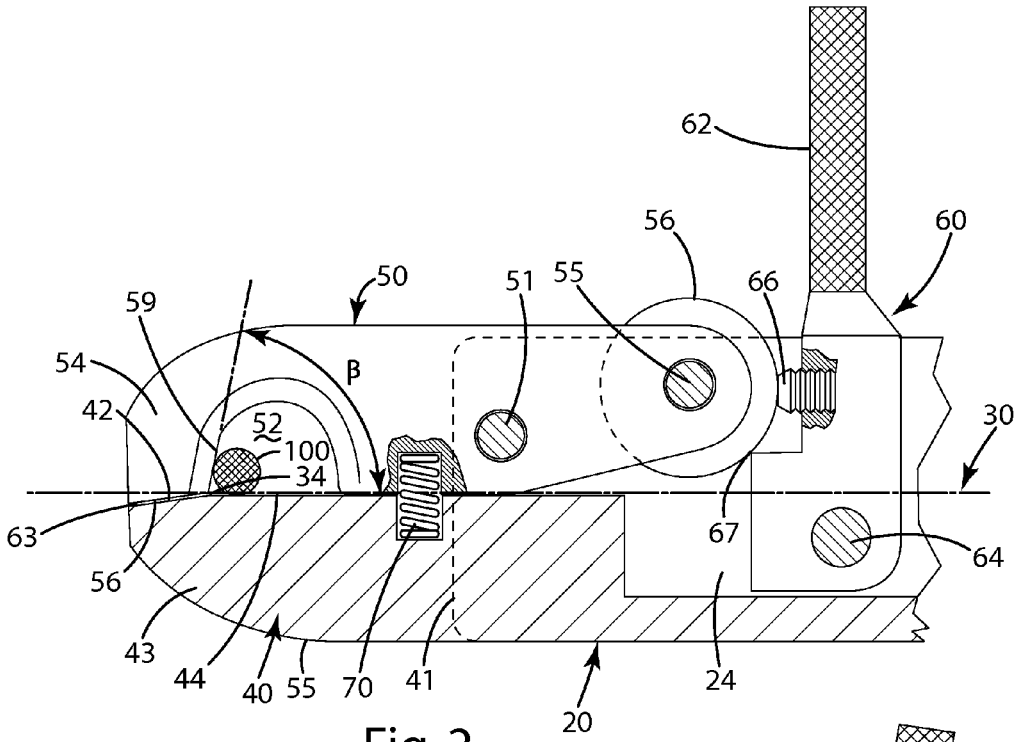
FIG. 2 is a partial sectional view of the release in a closed position.
Figure 3:
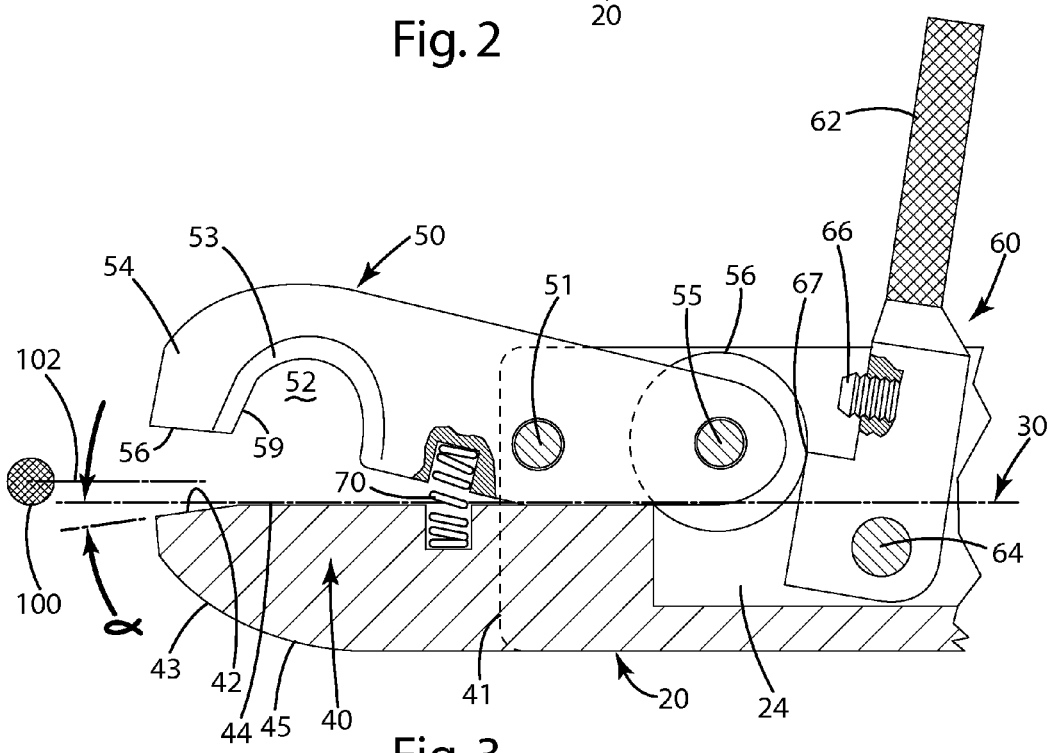
FIG. 3 is a partial sectional view of the release in an open position.

An embodiment of the archery release of the present invention is shown in FIGS. 1-3 and generally designated 10. The release 10 generally includes a release body 20 including a longitudinal axis 30, a fixed jaw 40, a movable jaw 50, and a trigger mechanism 60. The fixed jaw can include a bowstring facing surface 42 that is offset at a predetermined angle from the longitudinal axis 30. The movable jaw 50 can define a bowstring notch 52, and include a forward end 54 located forward of the notch 52. The forward end 54 can include a forward surface 56, which also can be offset from the longitudinal axis 30 of the release body 20.

The release is used to assist in drawing and releasing the bowstring 100. When the release is a closed position, as shown in FIG. 1, and used to draw the bowstring 100, the offset predetermined angle prevents or reduces forcing of the bowstring into the gap 34 between the forward surface 56 of the movable jaw and the bowstring facing surface 42 of the fixed jaw. When the release is actuated from a closed position (FIG. 2) to an open position (FIG. 3), the bowstring fails to substantially contact the bowstring facing surface 42, which results in a cleaner, more consistent release of the bowstring 100. Likewise, where the forward surface 56 of the movable jaw is at the predetermined angle, that forward surface 56 easily and quickly moves out of the travel path of the bowstring 100 upon release.

The following terms will have the definitions presented. As used herein, "bowstring" refers to an actual bowstring of an archery bow and any device or component adapted to join with a bowstring of an archery bow and aid an archer in drawing or releasing the bowstring, including: rope loops, which are attached to the bowstring above and below the location where an arrow nock rests; and receivers, for example, a metal loop or partial loop that is joined with the bowstring above and below, or only above, or only below the location where the arrow nock rests on the bowstring.

As used herein "archery bow" refers to any compound bow, recurve bow, long bow, crossbow or any other device that propels or is capable of propelling an arrow, bolt or other similar projectile.

As used herein "bowstring facing surface" refers to one or more surfaces of a fixed jaw which at least momentarily faces the bowstring as an opposing, movable jaw is in its open position or closed position. The bowstring facing surface, need not be adjacent and facing the bowstring when the movable jaw and/or release is in a closed position. For example, the bowstring facing surface may be located slightly forward of the bowstring, yet still considered a bowstring facing surface.

II. Components

Referring to FIGS. 1-4, the components of the release 10 will now be described in detail. The release body 20 generally includes an elongate housing 22, which can be of virtually any geometric shape. The housing 22 can define a recess 24 sufficiently sized to house all or a portion of the other components of the release. The housing 22 can further define apertures to accommodate various pivot elements, such as pins, to join the trigger mechanism 60 and movable jaw 50 with the housing as desired. The release body 20 optionally can further be coupled to a base 26. The base can be a shaft or other structure adapted to join the release body with a handle (not shown) or wrist strap 110. An exemplary construction for a handle is a simple T handle including one or more grooves for the digits of an archer's hand. Other handle constructions may be substituted as desired. An exemplary wrist strap is shown in U.S. Pat. No. 5,595,167 to Scott, which is hereby incorporated by reference. Other buckle, Velcro® or loop wrist straps may be substituted as desired.

As shown in FIGS. 1 and 2, the release body includes a longitudinal axis 30 which generally extends the length of the release body 20. In general, this longitudinal axis is typically aligned with and/or parallel to the forward travel path 102 of a bowstring 100 as it is released from the release 10. Of course, in some circumstances, the longitudinal axis 30 may not be perfectly aligned with that bowstring travel path, depending on the configuration of the bowstring and archery bow to which it is attached.

With reference to FIGS. 2 and 3, the trigger mechanism 60 includes a trigger 62 which extends from the body and is accessible by an archer with one of the archer's digits, for example, an index finger or a thumb depending on the desired configuration. The trigger 62 pivots about a pivot pin 64 which is located within the recess 24 defined by the housing 22. The trigger can include an adjustment element 66 which, for example, can be a set screw that is threadably engaged with the trigger 62. Adjustment element 66 can be threaded inward or outward with respect to the trigger 62 to control the distance between the adjustment element 66 and the jaw roller 56, thereby adjusting the sensitivity of the trigger pull.

The trigger mechanism 60 can include a sharp shouldered or ridged sear 67 which is adapted to engage the roller 56 as described below. The particular angle and configuration of this sear 67 can be modified to provide the desired travel and sensitivity of the trigger. The illustrated trigger mechanism is but one example, and it should be noted that any other desired construction adapted to move the movable jaw 50 relative to the fixed jaw 40 can be substituted with the present invention.

The release body 20 can include an integral or non-integral fixed jaw 40. The fixed jaw 40 can extend forwardly from the release body 20. The fixed jaw 40 can include a release body end 41 located proximal to the release body 20, and a terminating end 43 which is distal from the release body 20. Generally, the terminating end 43 is passed by a bowstring 100 released from the release 10.

The fixed jaw 40 can include an outer portion 45. This outer portion can be curved or angled as desired. The fixed jaw also can include an inner portion 44 which is separated from the outer portion by a thickness which, of course, can vary from the release end 41 to the terminating end 43 as desired. The inner portion 44 of the fixed jaw 40 can include along at least a portion thereof a bowstring facing surface 42. This surface can extend from the release body 20 all the way to the terminating end 43, or can extend along only a part of the inner portion 44 of the fixed jaw 40. Optionally, the bowstring facing surface 42 can extend along a quarter, a third or a half the length of the inner portion 44, rearward from the terminating end 43. Further optionally, the bowstring facing surface 42 can extend about 0.75", 0.50", 0.40", 0.30" or about 0.20" rearward from the terminating end 43 of the fixed jaw 40. The bowstring facing surface 42 generally can be located adjacent the bowstring notch 52 and/or slightly forward of the bowstring notch 52 as desired.

Figure 6:
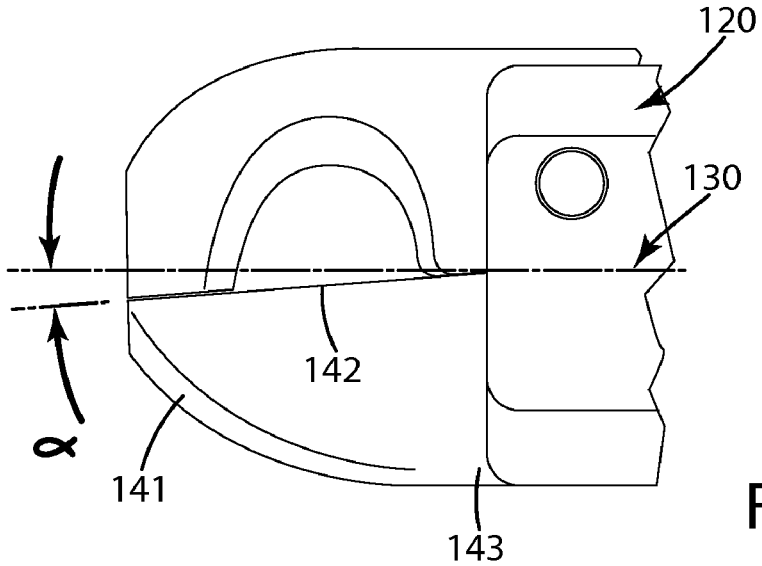
FIG. 6 is a top view of a second alternative embodiment of the release in a closed position.

Although the bowstring facing surface 42 shown in FIG. 3 extends only along a portion of the fixed jaw 40, this surface can be constructed as shown in the alternative embodiment shown in FIG. 6. There, the bowstring facing surface 142 extends from the release body end 141 all the way to the terminating end 143 of the fixed jaw 140. This entire surface 142 is offset at an angle relative to the longitudinal axis 130 of the release body 120.

Returning to FIGS. 1-3, the bowstring facing surface 42 of the fixed jaw 40 can be offset at a predetermined angle $\alpha$ from the longitudinal axis 30 of the release body 20. For example, the bowstring facing surface can be angled away from the longitudinal axis 30, in a divergent manner, from the release body end 41 toward the terminating end 43 or along a portion thereof. Optionally, the predetermined angle $\alpha$ can be about 0.1° to about 30° offset from the longitudinal axis, about 0.1° to about 25° offset from the longitudinal axis, about 0.1° to about 15° offset from the longitudinal axis, about 0.1° to about 6° offset from the longitudinal axis, about 0.1° to about 3° offset from the longitudinal axis, or about 3° offset from the longitudinal axis.

Figure 4:
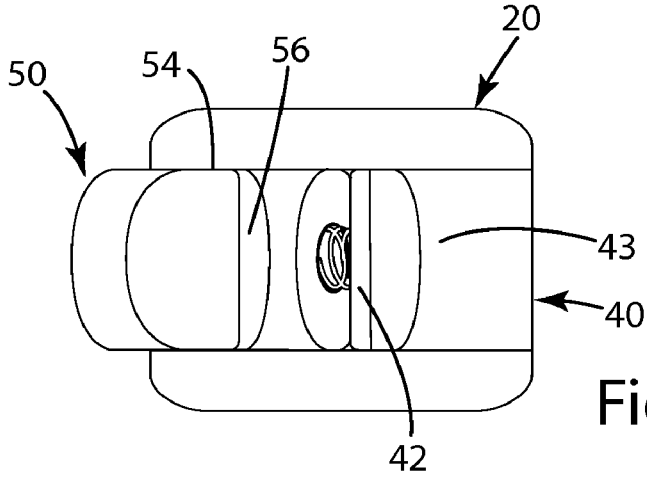
FIG. 4 is a front view of the release in an open position.
Figure 5:
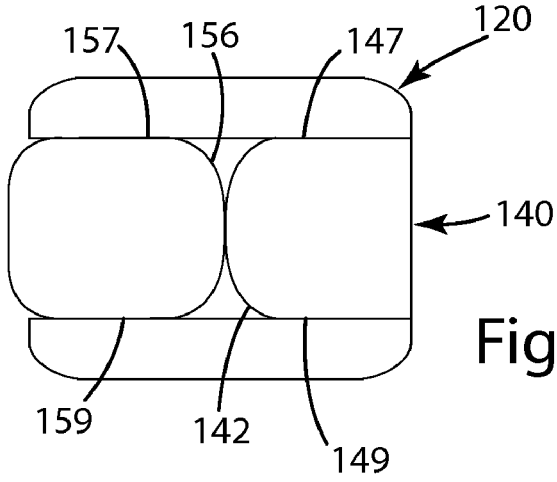
FIG. 5 is a front view of a first alternative embodiment of the release in a closed position.

The bowstring facing surface 42, as shown in FIGS. 3 and 4, can be substantially planar as desired. As shown in FIG. 5, however, an alternative bowstring facing surface 142 can be in a curvilinear or other geometric shape as it transitions from the top 147 of the fixed jaw to the bottom 149 of the fixed jaw 140. This curvilinear shaped, alternative bowstring facing surface 142 can likewise be offset at a predetermined angle $\alpha$ from the longitudinal axis 30.

Like the fixed jaw 40, the movable jaw 50 can be constructed in a variety of configurations. In general, a suitable construction enables the forward end 54 of the movable jaw 50 to move away from the fixed jaw 40. An example of such a construction is shown in FIGS. 1-4. There, the movable jaw 50 is pivotally mounted via a pivot element 51 to the release body housing 22. At a rearward portion of the movable jaw 50, a roller 56 is joined with the movable jaw 50 via a pin 55. The roller 56 as shown is generally cylindrical and can rotate about the pin 55 as desired. In general, the roller 56 is constructed to engage the sear 67 of the trigger mechanism 60. A variety of other elements can be substituted for the roller 56, such as ball bearings, non-rotating elements, sliding elements or any structure that enables the rearward portion of the movable jaw 50 to slide along or otherwise move relative to the trigger mechanism 60 so that the moveable jaw 50 is actuated and moves.

As shown in FIG. 3, the movable jaw 50 defines a bowstring notch 52. The bowstring notch can include a curvilinear, planar or other smooth surface 53, which can be configured to minimize wear on a bowstring. The bowstring notch can face the fixed jaw 40 and can open generally facing the longitudinal axis 30 of the release body. In general, the notch can be a U or V shaped opening or recess in the moveable jaw 40, generally configured to capture at least a portion of the bowstring 100.

In the embodiment shown in FIGS. 1-3, the bowstring notch 52 can include a forward notch surface 59. The surface 59 can be disposed at a secondary offset angle $\beta$ relative to the longitudinal axis 30 when the moveable jaw is in a closed position. This secondary offset angle $\beta$ optionally can be about 89.9° to about 45°, about 89.9° to about 75°, about 89.9° to about 80°, or about 5° offset relative to the longitudinal axis, and further optionally relative to a plane extending through the longitudinal axis that is generally parallel to the travel path 102 of the bowstring 100. Of course, the forward bowstring notch surface 59 can also be at a right angle relative to the longitudinal axis 30 as desired.

The movable jaw can also include a forward end 54, located forward of the notch 52. That forward end 54 can include a forward end surface 56 which can oppose the bowstring facing surface 42 or other part of the inner portion 44 between the release body end 41 and the terminating end 43 of the fixed jaw 40. This forward end surface 56 can optionally be offset at a predetermined angle $\alpha$ relative to the longitudinal axis of the release body 20. For example, the predetermined angle $\alpha$ can be about 0.1° to about 30° offset from the longitudinal axis, about 0.1° to about 25° offset from the longitudinal axis, about 0.1° to about 15° offset from the longitudinal axis and further optionally about 0.1° to about 6° offset from the longitudinal axis, about 0.1° to about 3° offset from the longitudinal axis, or about 3° offset from the longitudinal axis.

The forward end surface 56 can be of a substantially planar configuration as shown in FIG. 4; however, that configuration can be varied as desired. For example, as shown in FIG. 5, an alternative forward surface 156 can contoured in a curvilinear manner from top 157 to bottom 159 of the movable jaw. Further alternatively, the forward surface 56 can be stepped at different angled portions, or chamfered (not shown) as desired.

Returning to FIG. 2, the forward end surface 56 can directly oppose the bowstring facing surface 42. In this configuration, the forward end surface 56 and the bowstring facing surface 42 can be substantially parallel to one another, and can be adjacent one another as well. While in the closed position, the forward end surface 56 and the bowstring facing surface 42 are adjacent one another, yet there is a small gap 63 therebetween. This gap 63 can range from about 0.001 mils to about 0.5 mils, about 0.01 mils to about 0.1 mils, or other distances depending on the desired tolerance.

Between the movable jaw 50 and the fixed jaw 40, or optionally the release body 20, a bias member 70, such as a coil spring, a leaf spring, a rubber or other elastomeric element, can be positioned to urge the forward end 54 of the movable jaw 50 away from the fixed jaw 40 when the trigger mechanism 60 actuates the movable jaw 50 to move. Although shown forward of the pivot pin 51, the bias member 70 can be located rearward of the pivot pin 51 to assist in urging the forward end 54 of the movable jaw away from the fixed jaw. Other mechanisms for performing similar movement can be substituted as desired.

The release 10 and its various components can be constructed from a variety of materials, for example, metal, such as steel, stainless steel and aluminum, as well as other synthetic materials such as polymers, and any combination of the foregoing. Further, the release 60 and its components can be treated with special processes, for example, anodizing, dipping or filming to provide the release and its components with a desired finish and appearance.

III. Method of Manufacture and Operation

In general, the various components of the release 10 can be molded, machined or extruded to obtain their desired configuration. The components can also be treated with special processes as described above to provide a desired finish. With the components constructed, the release 10 is assembled.

To assemble the release, the roller 56 is joined with the movable jaw 50 via the pin 55. The trigger 62 is joined with the release body housing 22 via the pin 64. The bias member 70 is positioned between the fixed jaw 40 and the movable jaw 50, and the movable jaw 50 is joined with the release body 20 via the pivot pin 51. The sensitivity of the trigger 62 can be set with the adjustment element 66. The various components can be ground or filed to remove to any excess material and lubricated to optimize movement and provide crisp actuation as desired.

In operation, an archer actuates the release 10 so that the movable jaw is in the open position shown generally in FIG. 3. The archer then positions the fixed jaw 40 and movable jaw 50 adjacent the bowstring 100 of the archery bow the archer intends to draw with the release 10. The release 10 grasps the bowstring with the movable jaw 50 so that the bowstring is within the notch 52. The movable jaw 50 is then moved toward the fixed jaw 40 to capture the bowstring 100. In this configuration, the movable jaw 50 is positioned in a closed position. The archer then draws the bowstring to a drawn state with the assistance of the release 10. As the bowstring is drawn, it exerts its substantial force on the forward bowstring notch surface 59; however, due to the offset angle of the bowstring facing surface 42 and/or the offset angle of the forward end surface 56, the bowstring 100 does not fight the gap 63, that is, it is not forcibly crammed into that gap as the bowstring is drawn or hold in a drawn state.

When the archer has satisfactorily aimed the bow, the archer actuates the release 10 with the trigger mechanism 60 to release the bowstring. The sequence of the release is generally as follows. The trigger 62 pivots clockwise about the pivot pin 64 in transitioning from FIG. 2 to 3. In this motion, the sear 67 passes a centerline extending from the center of the pin 51 to the center of the pin 64. The movable jaw 40 continues to rotate with the front end 54 being urged away from the fixed jaw 40 by expansion of the bias member 70. As the movable jaw 40 opens, and the front end 54 moves away from the fixed jaw 50, the bowstring 100 exits the bowstring notch traveling forward along its travel path 102.

As the bowstring 100 travels forward, the string 100 moves past at least a portion of the offset bowstring facing surface 42. Because the bowstring facing surface 42 is offset at a predetermined angle $\alpha$ relative to the longitudinal axis of the release body, the bowstring does not or only minimally contacts at least a portion of the bowstring facing surface 42. This in turn eliminates or reduces any effect that the fixed jaw 40 may have on the release of the bowstring 100 and thus reduces erratic flight of the arrow as it leaves the bowstring. Further, where the forward end surface 56 is offset at a predetermined angle $\alpha$ or some other angle, that surface 56 rapidly and cleanly moves out of the travel path of the bowstring 100 as it is released.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The invention claimed is:

1. An archery release comprising:

a release body having a longitudinal axis;

a trigger joined with the release body;

a fixed jaw extending immovably from the release body, the fixed jaw including a first surface being offset at a first predetermined angle from the longitudinal axis of the release body; and an elongate movable jaw joined with the release body, the moveable jaw moveable between a closed position and an open position, the movable jaw defining a bowstring notch that faces the fixed jaw, the moveable jaw including a forward end located forward of the bowstring notch, the forward end including a second surface being offset at a second predetermined angle from the longitudinal axis of the release body, wherein the first surface of the fixed jaw opposes the second surface of the moveable jaw, and is substantially parallel and adjacent to the second surface of the moveable jaw, when the movable jaw is in the closed position, wherein at least a portion of the first surface of the fixed jaw is located forward of the bowstring notch, wherein the trigger actuates the elongate movable jaw so that the elongate moveable jaw moves from the closed position to the open position, whereby the release releases a bowstring disposed in the bowstring notch.

2. The archery release of claim 1 wherein at least one of the first predetermined angle and the second predetermined angle is about 0.1° to about 30° offset from the longitudinal axis.

3. The archery release of claim 1 wherein at least one of the first predetermined angle and the second predetermined angle is about 0.1° to about 5° offset from the longitudinal axis.

4. The archery release of claim 1 wherein at least one of the first predetermined angle and the second predetermined angle is about 3° offset from the longitudinal axis.

5. The archery release of claim 1 wherein the second surface of the moveable jaw and the first surface of the fixed jaw are both substantially planar.

6. The archery release of claim 1 comprising a biasing member positioned between the fixed jaw and the moveable jaw, the biasing member urging the second surface of the moveable jaw away from the fixed jaw when the trigger is actuated.

7. The archery release of claim 1 wherein the bowstring notch includes a forward bowstring notch surface which engages a bowstring when the moveable jaw is in the closed position, the forward bowstring notch surface angled at a secondary offset angle relative to the longitudinal axis when the moveable jaw is in a closed position.

8. The archery release of claim 7 wherein the secondary offset angle is between about 0.1° and about 30°.

9. The archery release of claim 1 wherein the fixed jaw includes a terminating end distal from the body, the first surface being located adjacent the terminating end.

10. The archery release of claim 9 wherein the fixed jaw includes a body end proximal the body, the body end being parallel to the longitudinal axis of the body.

11. An archery release comprising:

a release body having a longitudinal axis;

a fixed jaw, immovably joined with the release body, the fixed jaw including an offset bowstring facing surface being offset at a first predetermined angle from the longitudinal axis of the release body; and an elongate, movable jaw opposing the fixed jaw, the moveable jaw defining a bowstring notch which opens facing the fixed jaw, the moveable jaw including a forward end which is forward of the bowstring notch, the moveable jaw moveable between a closed position and an open position, wherein the forward end of the moveable jaw is separated from the offset bowstring facing surface by a gap when the moveable jaw is in the closed position, wherein a bowstring held at least partially in the bowstring notch is restricted from entering the gap when the moveable jaw is in the closed position.

12. The archery release of claim 11 comprising a bias member disposed between the moveable jaw and the fixed jaw, and adapted to urge the moveable jaw away from the fixed jaw.

13. The archery release of claim 11 wherein the movable jaw is movably joined with the release body with a pivot element located rearward of the bowstring notch.

14. An archery release comprising:

a release body having a longitudinal axis;

a fixed jaw, immovably joined with the release body, the fixed jaw including a bowstring facing surface being offset at a first predetermined angle from the longitudinal axis of the release body;

an elongate, movable jaw opposing the fixed jaw, the moveable jaw defining a bowstring notch which opens facing the fixed jaw, the moveable jaw including a forward end which is forward of the bowstring notch;

wherein the forward end includes a forward end surface which opposes the bowstring facing surface, the forward end surface being offset at a second predetermined angle from the longitudinal axis of the release body;

wherein at least one of the first predetermined angle and the second predetermined angle is about 0.1° to about 15° offset from the longitudinal axis; and wherein the forward end surface and the bowstring facing surface are substantially parallel when the moveable jaw is in a closed position.

15. A method for releasing a bowstring comprising:

providing a release including a release body having a longitudinal axis, a fixed jaw having a bowstring facing surface being offset at a first predetermined angle from the longitudinal axis of the release body, and an elongate, movable jaw joined with the release body, the moveable jaw including a bowstring notch and opposing the fixed jaw;

grasping the bowstring with the moveable jaw so that the bowstring is located within the bowstring notch;

moving the moveable jaw toward the fixed jaw to capture the bowstring in a closed position of the moveable jaw;

drawing the bowstring to a drawn state with the assistance of the release;

opening the moveable jaw to release the bowstring from the release so that the bowstring travels forward, past at least a portion of the bowstring facing surface without contacting the at least a portion of the bowstring facing surface; and wherein the moveable jaw is separated from the offset bowstring facing surface by a gap when the moveable jaw is in the closed position, and wherein the bowstring is restricted from entering the gap during said drawing step.

16. The method of claim 15 wherein the release body includes a bias member, wherein the bias member urges the moveable jaw toward an open position during said opening step.

17. The method of claim 15 wherein the bowstring facing surface is substantially planar, and the first predetermined angle is about 0.1° to about 5°.

18. An archery release comprising:

a release body having a longitudinal axis;

a fixed jaw, immovably joined with the release body, the fixed jaw including an offset bowstring facing surface being offset at a first predetermined angle from the longitudinal axis of the release body;

an elongate, movable jaw opposing the fixed jaw, the moveable jaw defining a bowstring notch which opens facing the fixed jaw, the moveable jaw including a forward end which is forward of the bowstring notch;

wherein the offset bowstring facing surface is separated from the moveable jaw by a gap defined between the offset bowstring facing surface and the forward end, forward of the bowstring notch, when the moveable jaw is in a closed position.

19. The archery release of claim 18 wherein the fixed jaw includes a top surface and an opposing bottom surface;

wherein the offset bowstring facing surface extends from the top surface to the bottom surface; and wherein the offset bowstring facing surface is substantially planar from the top surface to the bottom surface in an area of the offset bowstring facing surface that faces toward the forward end of the moveable jaw forward of the bowstring notch.

20. The archery release of claim 18 wherein the fixed jaw includes a top surface and an opposing bottom surface;

wherein the offset bowstring facing surface extends from the top surface to the bottom surface; and wherein the offset bowstring facing surface is substantially curvilinear as the offset bowstring facing surface transitions from the top surface to the bottom surface in an area of the offset bowstring facing surface that faces toward the forward end of the moveable jaw, forward of the bowstring notch.

21. The archery release of claim 18 wherein the offset bowstring facing surface and the bowstring notch are adapted to cooperatively hold a bowstring at least partially within the bowstring notch when the moveable jaw is in the closed position.

* * * * *